US008104180B2

(12) United States Patent
Swinford

(10) Patent No.: US 8,104,180 B2
(45) Date of Patent: Jan. 31, 2012

(54) TOOL FOR CUTTING TIE WRAPS

(76) Inventor: Eric Swinford, Odessa, TX (US)

( * ) Notice: Subject to any disclaimer, the term of this patent is extended or adjusted under 35 U.S.C. 154(b) by 580 days.

(21) Appl. No.: 12/021,778

(22) Filed: Jan. 29, 2008

(65) Prior Publication Data

US 2009/0188118 A1 Jul. 30, 2009

(51) Int. Cl.

| | |
|---|---|
| ***B26B 13/00*** | (2006.01) |
| ***B26F 1/00*** | (2006.01) |
| ***B25B 7/22*** | (2006.01) |
| ***B26B 13/22*** | (2006.01) |
| ***A45D 29/18*** | (2006.01) |

(52) U.S. Cl. ..... 30/252; 30/363; 7/132; 132/73.5

(58) Field of Classification Search ..... 30/252, 30/250, 258, 229, 363, 92, 178, 254, 131; 7/132; 132/73.5, 75.5

See application file for complete search history.

(56) References Cited

U.S. PATENT DOCUMENTS

| | | | | |
|---|---|---|---|---|
| 1,677,684 | A | 7/1928 | Parsons | |
| 1,812,484 | A | 6/1931 | Howe | |
| 1,938,666 | A | 12/1933 | Novy et al. | |
| 3,221,576 | A * | 12/1965 | Goetz | 81/9.43 |
| 3,854,202 | A * | 12/1974 | Cortese et al. | 30/91.2 |
| 4,106,195 | A * | 8/1978 | Berg | 30/293 |
| 4,283,933 | A * | 8/1981 | Wiener | 72/409.12 |
| 4,876,795 | A * | 10/1989 | Chun-cheng | 30/254 |
| 5,150,522 | A * | 9/1992 | Gwo-Jiang | 30/91.2 |
| 5,542,182 | A * | 8/1996 | Martinez | 30/179 |
| 5,822,865 | A * | 10/1998 | Bosch et al. | 30/134 |
| 5,832,612 | A * | 11/1998 | Cornell et al. | 30/233 |
| 6,752,053 | B2 | 6/2004 | Rubicam | |
| 7,174,640 | B2 * | 2/2007 | Elkins | 30/357 |
| 2005/0097758 | A1 | 5/2005 | Elkins | |
| 2005/0262697 | A1 * | 12/2005 | Stein | 30/92 |
| 2007/0204470 | A1 * | 9/2007 | Lai | 30/244 |

* cited by examiner

*Primary Examiner* — Ghassem Alie
*Assistant Examiner* — Bharat C Patel
(74) *Attorney, Agent, or Firm* — James E. Walton; Richard G. Eldredge

(57) ABSTRACT

A tie wrap cutting tool has a press arm and a die arm, each arm having a tool end and an opposing handle. The arms are pivotally coupled together, such that relative movement of the handles produces a corresponding movement of the tool ends. A cutting insert is removably coupled to the tool end of the die arm, the cutting insert having a transverse guide slot configured for receiving a tie wrap to be cut. At least one cutter is carried by the cutting insert, the cutter having a selected geometric shape. A press face is formed in the press arm for forcing the tie wrap against the at least one cutter, so that selected movement of the handles causes the at least one cutter to cut the selected geometric shape in a tie wrap received in the slot.

9 Claims, 5 Drawing Sheets

TOOL FOR CUTTING TIE WRAPS

BACKGROUND

1. Field of the Invention

The present invention relates generally to hand-operated tools and specifically to hand-operated tools for cutting tie wraps.

2. Description of Related Art

Many types of cutters have been disclosed for cutting metal or plastic bindings. In particular, various cutters for steel box strapping or plastic tie wraps (also called zip ties) have been disclosed that cut the unwanted end portion of the straps or tie wraps and leave a rounded end on the remaining portion. The rounded ends prevent injuries to those handling the items encircled with the straps or tie wraps.

For example, U.S. Pat. No. 1,677,684 to Parsons discloses a tool for cutting the ends of metal straps and uses a punch-and-die arrangement to leave a rounded end on the strap. U.S. Pat. No. 1,812,484 to Howe provides for improvements on the Parsons tool by providing a receptacle for clippings. U.S. Pat. No. 1,938,666 to Novy, et al. provides for a similar tool for cutting rounded ends and that is particularly adapted for use with seals used to retain together the ends of metal strapping.

For use with plastic tie wraps, U.S. Pat. No. 6,752,053 to Rubicam discloses tools having curved blades. U.S. Pat. No. 7,174,640 to Elkins discloses a pliers-like hand tool having cutting edges and grooved guides in each jaw of the tool, which is used for cutting off the unwanted end of a tie wrap and leaving a rounded end. Likewise, U.S. Pat. Appl. 2005/0097758 to Elkins discloses a pliers like hand tool having cutting edges in each jaw of the tool for cutting a rounded end on a tie wrap.

Although great strides have been made in the area of tie wrap cutters, many shortcomings remain.

DETAILED DESCRIPTION OF THE PREFERRED EMBODIMENT

Figure 1:
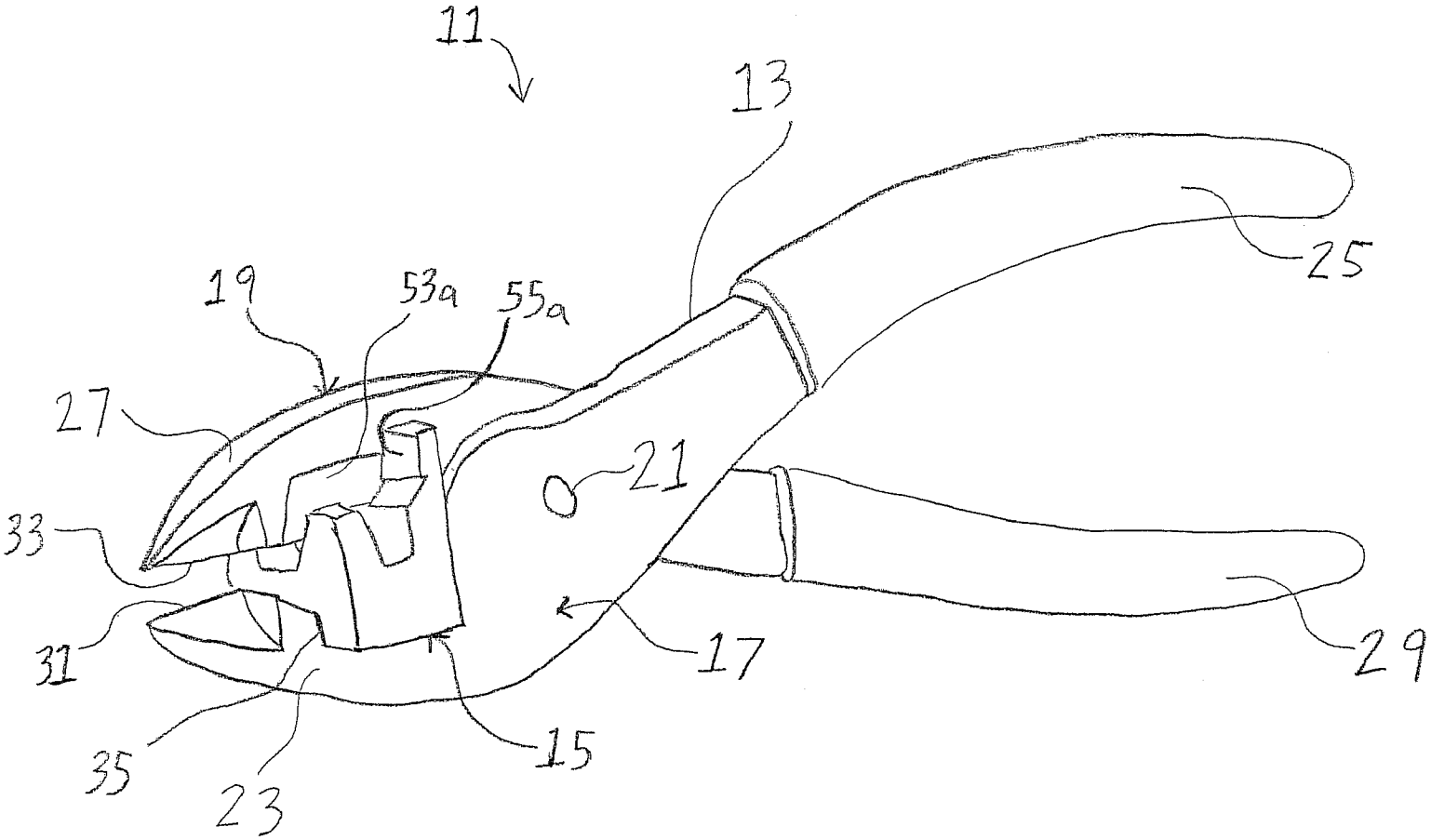
FIG. 1 is an oblique view of a tool for cutting tie wraps.
Figure 2:
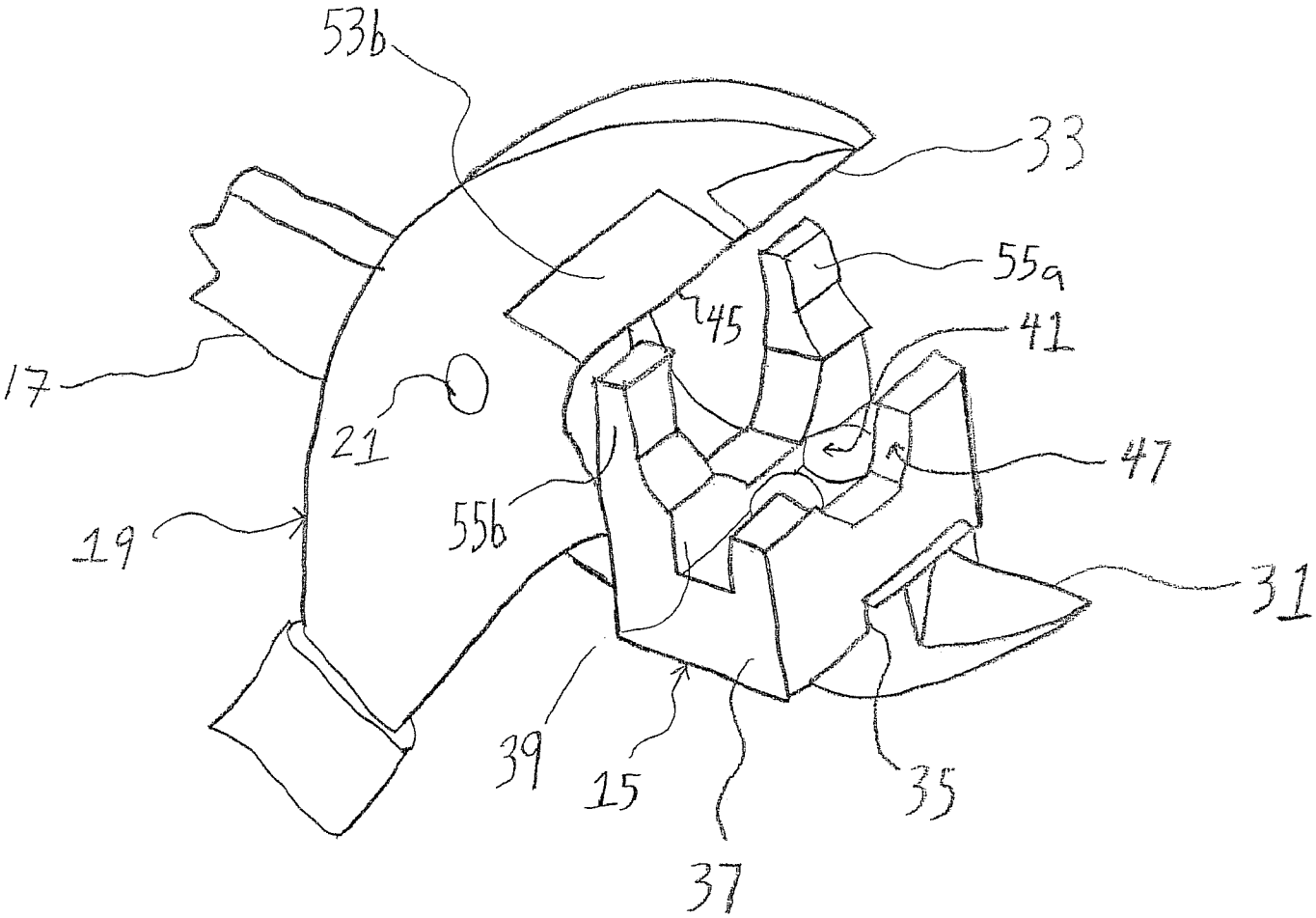
FIG. 2 is an oblique view of a forward portion of the tool of FIG. 1.
Figure 3:
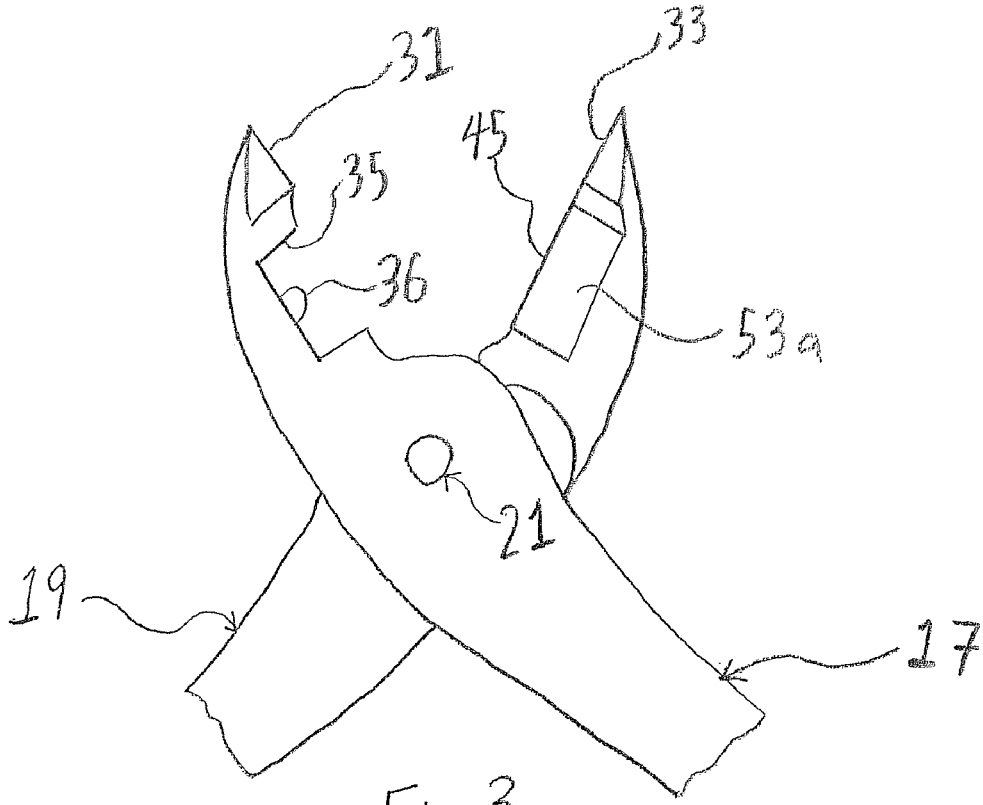
FIG. 3 is a side view of a forward portion of the tool of FIG. 1, an insert having been removed.
Figure 4:
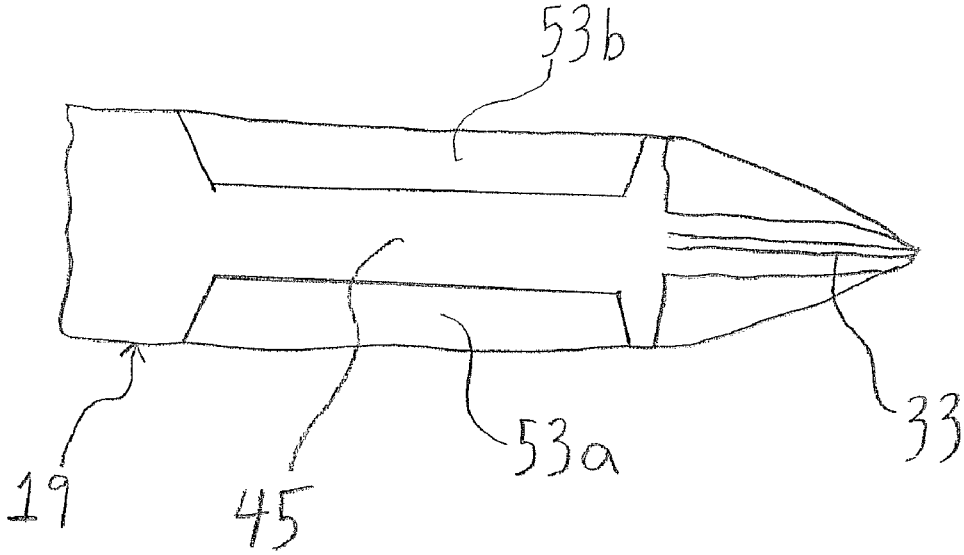
FIG. 4 is a bottom view of a portion of an arm of the tool of FIG. 1.

Referring to FIGS. 1-5 in the drawings, a tie wrap cutting tool 11 according to a preferred embodiment of the present application is illustrated. Tie wrap cutting tool 11 comprises a pliers portion 13 and a cutter insert 15 removably carried by pliers portion 13. Pliers portion 13 comprises a die arm 17 and a press arm 19, arms 17, 19, being pivotally connected to each other in a single plane with a pivot pin 21. Die arm 17 has a tool end 23 and an opposing handle 25, and press arm also has a tool end 27 and an opposing handle 29. Relative movement of handles 25, 29 produces similar relative movement between tool ends 23, 27. For example, when handles 25, 29 are moved away from each other, tool ends 23, 27 also move away from each other. Tool ends 23, 27 each comprise a straight cutter 31, 33, respectively, that engages with the other of cutters 31, 33 to cut items placed between cutters 31, 33. A spring (not shown) may be used to urge handles 25, 29 apart for biasing arms 17, 19 toward an open position.

Cutting insert 15 is carried in a rectangular notch 35 extending transversely through tool end 23 of die arm 17. Notch 35 allows for insert 15 to be removably inserted into notch 35 for use with pliers portion 13, though pliers portion 13 may be used without insert 15. For example, cutters 31, 33 may be used to cut tie wraps whether or not insert 15 is inserted in notch 35. To provide for positively locating insert in the center of notch 35, notch may include a spring-biased detent 36 that engages a detent relief formed in the lower surface of insert 15. Though not shown, notch 35 may also or alternatively include vertical or transverse slots for receiving corresponding rails formed on insert 15.

Figure 5:
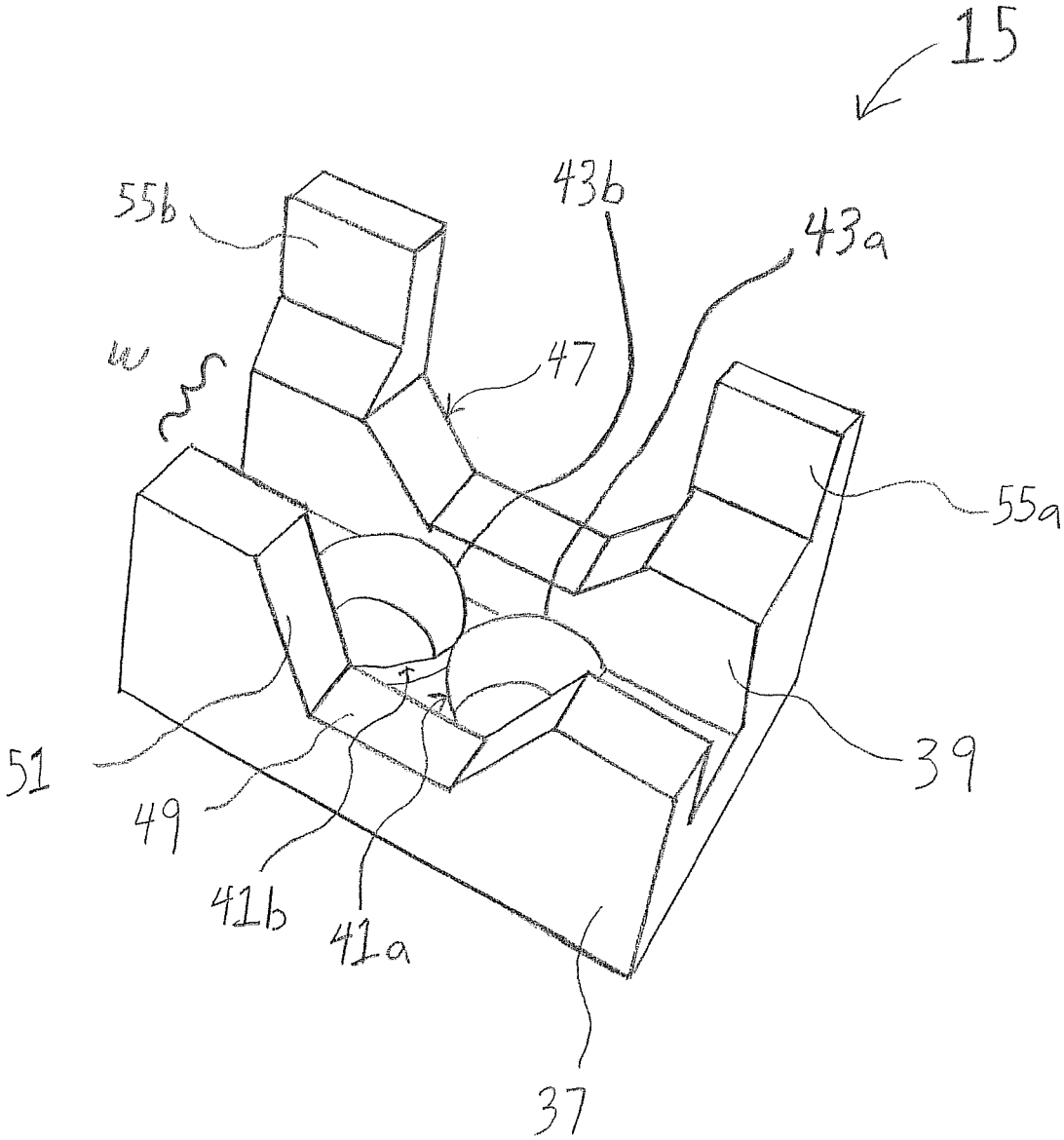
FIG. 5 is an oblique view of an insert of the tool of FIG. 1.

Insert 15 comprises a rectangular body 37 having a rectangular, transverse guide slot 39, which is configured to receive a tie wrap to be cut. Guide slot 39 has a width w, as shown in FIG. 5, that preferably matches the width of the tie wrap to be cut. The fact that insert 15 is removable allows for the use of interchangeable inserts 15 having guide slots 39 of selected different widths, so that a properly sized insert 15 may be used to cut tie wraps. Ideally, at least three inserts will be available, with each insert having a guide slot 39 in one of the following widths: 3/32", 5/32", and 9/32". Body 37 is preferably formed from a plastic material, such as nylon, or some other sufficiently rigid material.

Two curved cutters 41*a*, 41*b* are positioned in a bottom portion of guide slot 39 and extend above the bottom surface of slot 39. Curved cutters 41*a*, 41*b* are generally adjacent to each other in a tangential relationship, so that cutters 41*a*, 41*b* curve away from each other about parallel axes. Curved cutters 41*a*, 41*b* are preferably formed separately and installed into body 37 of insert 15, though cutters may be formed as an integral portion of body 37. Cutter 41*a*, 41*b* are also preferably formed from a metal, though other sufficiently rigid materials may be used. Curved cutters 41*a*, 41*b*, as shown in the figures, are formed as cylinders each having a cutting arc 43*a*, 43*b*, respectively, located toward the middle of guide slot 39. Forming curved cutters 41*a*, 41*b* as complete cylinders allows for the remaining portion of each cutter 41*a*, 41*b* to mechanically support the associated cutting arc 43*a*, 43*b*. Alternatively, curved cutters 43*a*, 43*b* may be formed as semi-circular arcs and installed or formed in guide slot 39 in a similar parallel, tangential arrangement.

Figure 6:
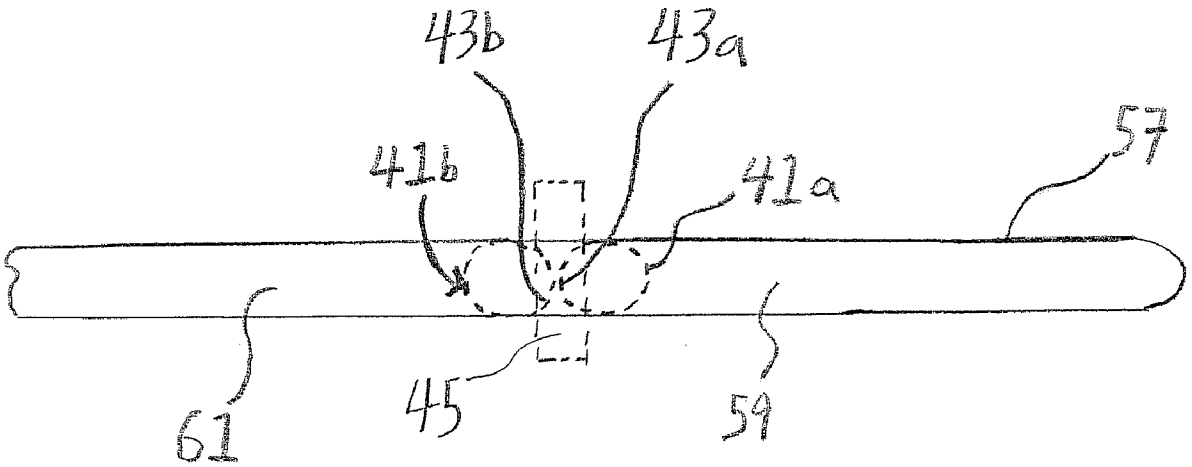
FIG. 6 is a top view of a portion of a tie wrap positioned over curved cutters of the tool of FIG. 1.

A tie wrap inserted into guide slot 39 is cut by pressing the tie wrap against curved cutters 41*a*, 41*b* with press arm 19. The orientation of a tie wrap to be cut to cutters 41*a*, 41*b* is shown in FIG. 6, which is described in detail below. Press arm 19 has a generally flat and inward-facing press face 45, which is aligned for engaging cutting arcs 43*a*, 43*b* when press face 45 is moved toward cutters 41*a*, 41*b*. In the embodiment shown, body 37 of insert 15 extends above cutters 41*a*, 41*b*, and a trapezoidal clearance slot 47 is formed in body 37 to allow for press arm 19 to move press face 45 into contact with cutters 41*a*, 41*b*. Bottom surface 49 of slot 47 lies slightly below the upper edges of cutting arcs 43*a*, 43*b* and each side surface 51 extends at an angle upward and away from bottom surface 49.

A narrowed section of press arm 19 is provided to allow press arm to move into clearance slot 47. Opposing surfaces 53*a*, 53*b* are formed in the sides of tool end 23, converging to provide for a minimum width of toll end 23 at press face 45. Surfaces 53*a*, 53*b* have similar angles as those of side surfaces 51, creating a cross-section of tool end 23 that generally corresponds to the cross-section of clearance slot 47.

To provide a means for guiding a tie wrap into guide slot 39, guides extend above guide slot 39 from body 37. In the embodiment shown, each guide comprises a guide 55*a*, 55*b* that extends vertically from body 37. Guides 55*a*, 55*b* cause a tie wrap placed between tool ends 23, 27 and located above guide slot 39 to move forward toward slot 39 as tool ends 23, 27 are moved toward each other. Though shown as having angled surfaces, guides may comprise other structures extending above guide slot 39, including pins or similar structures.

In operation, a tie wrap is inserted into guide slot 39 and handles 25, 29 are moved toward each other. If the tie wrap is located above guide slot 39, tie wrap slides along guide surfaces 55*a*, 55*b* as press face 45 forces the tie wrap toward guide slot 39. Press face 45 then forces the tie wrap against cutting arcs 43*a*, 43*b* of cutters 41*a*, 41*b* for cutting the tie wrap.

Figure 7:
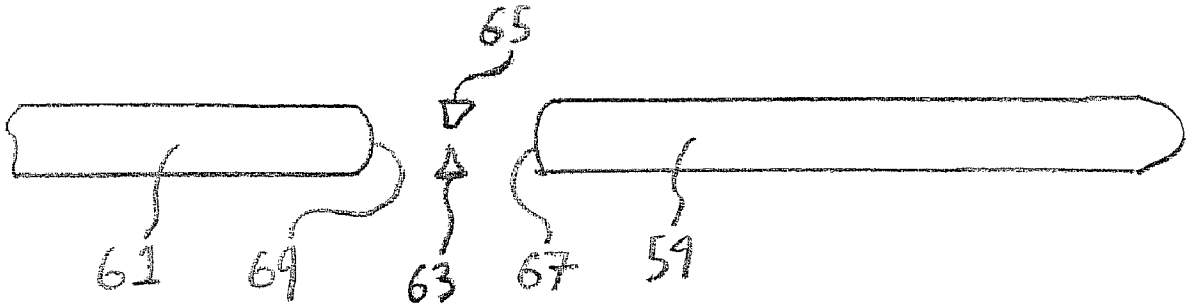
FIG. 7 is a top view of the tie wrap portion of FIG. 6 having been cut with the curved cutters.

Referring now to FIGS. 6 and 7, an end portion 57 of a tie wrap is shown from above and in the cutting configuration relative to cutters 41*a*, 41*b*. Tie wrap portion 57 comprises a discard portion 59, which is to be cut from a remaining portion 61. As shown in the previous figures, press face 45 (shown in phantom) is moved downward into clearance slot 47 and against the tie wrap, forcing the tie wrap against cutting arcs 43*a*, 43*b*, and this action cuts the tie wrap portion 57 into the pieces shown in FIG. 7. Discard portion 59 is severed from remaining portion 61, and two generally triangular pieces 63, 65 are also formed due to the curvature of cutting arcs 43*a*, 43*b*. Cutting arc 43*a* produces rounded end 67 on discard portion 57, and cutting arc 43*b* produces rounded end 69 on discard portion 61.

Though described above as having circular or arc-shaped cutters, cutters having other shapes may alternatively be used. Likewise, embodiments may only have one cutter in the insert or may have two dissimilar cutters.

The tool described above is useful in a method of cutting tie wraps. One method includes a first step of installing a removable first insert on a pliers-type tool, the first insert having at least one cutter and being adapted for cutting tie wraps. The second step is inserting a tie wrap having a selected width into a transverse guide slot of the first insert, the guide slot having a generally corresponding width. Finally, the method includes cutting the tie wrap by pressing the tie wrap against the at least one cutter through operation of the pliers-type tool.

Additionally, the method may be expanded to include use of interchangeable inserts. The first additional step includes removing the first insert and installing a second insert, the transverse guide slot of the second insert having a different width than the guide slot of the first insert and having at least one cutter adapted for cutting tie wraps. The next step is inserting a tie wrap having a corresponding width into the guide slot of the second insert, and the final step is cutting the tie wrap by pressing the tie wrap against the at least one cutter of the second insert through operation of the pliers-type tool. Additional methods include a step of selecting a removable cutting insert from a group of interchangeable cutting inserts having different cutting characteristics and then using the selected cutting insert to cut a tie wrap having a selected width corresponding to that of a guide slot of the selected insert. Additional steps may include removing the selected insert and installing a second selected insert, inserting a tie wrap having a corresponding width into the guide slot of the second selected insert, and then cutting the tie wrap with the second selected insert.

The tie wrap cutting tool provides several advantages, including: (1) simple operation; (2) interchangeability of cutting inserts for different sizes of tie wraps; (3) the ability to use the tool to cut items using the straight cutter whether or not the insert is installed; and (4) improved methods of cutting tie wraps.

While this invention has been described with reference to at least one illustrative embodiment, this description is not intended to be construed in a limiting sense. Various modifications and combinations of the illustrative embodiments, as well as other embodiments of the invention, will be apparent to persons skilled in the art upon reference to the description.

I claim:

1. A tie wrap cutting tool for a tie wrap having a length and a width, comprising:

a press arm and a die arm, each arm having a tool end and an opposing handle, the arms being pivotally coupled together, such that relative movement of the handles produces a corresponding movement of the tool ends, the tool end of the die arm having:

a notch; and a spring-biased detent positioned within the notch;

a cutting insert adapted to be removably coupled to the notch of the tool end of the die arm, the cutting insert having:

a detent relief formed in a lower surface, the detent relief being adapted to engage with the spring-biased detent of the die arm; and a guide extending transverse relative to the longitudinal length of the die arm, the guide having:

a guide slot extending relatively transverse to the longitudinal length of the die arm, the guide slot being adapted to receive the tie wrap, the guide slot having a width matching the tie wrap width; and a clearance slot extending relatively perpendicular to the guide slot, the clearance slot having a bottom surface;

a first cutter positioned within the guide slot, the first cutter having a selected geometric shape, the first cutter extending from a bottom portion of the guide slot;

a second cutter positioned within the guide slot, the second cutter having a selected geometric shape, the second cutter extending from the bottom portion of the guide slot, the second cutter being generally adjacent to the first cutter in a tangential relationship so that the first cutter and the second cutter curve away from each other about a parallel axis; and a press face formed in the press arm, the press face being adapted to force the tie wrap against the at least one cutter, the clearance slot of the cutting insert being adapted to receive the press face, the press face having:

a bottom flat face configured to press the tie wrap simultaneously against the first cutter and the second cutter;

wherein the bottom surface is positioned below the first cutter and the second cutter, and configured to stop movement of the bottom flat face of the press arm; and wherein selected movement of the handles causes the first cutter and the second cutter to cut the selected geometric shape in a tie wrap received in the guide slot.

2. The tool according to claim 1, wherein the selected geometric shape of the first cutter is circular.

3. The tool according to claim 1, wherein the selected geometric shape of the first cutter is non-circular.

4. The tool according to claim 1, wherein the the first cutter and the second cutter have the same selected geometrical shape.

5. The tool according to claim 1, wherein the the first cutter and the second cutter have a circular geometrical shape.

6. The tool according to claim 1, wherein the the first cutter and the second cutter have dissimilar selected geometrical shapes.

7. The tool according to claim 1, wherein the insert is formed from a plastic material.

8. The tool according to claim 1, wherein the insert is formed from nylon.

9. The tool according to claim 1, wherein the first cutter is formed from a metallic material.

* * * * *